US008007368B2

(12) United States Patent
Solheim et al.

(10) Patent No.: US 8,007,368 B2
(45) Date of Patent: Aug. 30, 2011

(54) METHODS, APPARATUS, AND SYSTEMS TO IDENTIFY ADDRESS POSITION OF GOLF CLUB HEADS

(75) Inventors: Karsten D. Solheim, Phoenix, AZ (US); Jeff A. Blankenship, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 12/572,144

(22) Filed: Oct. 1, 2009

(65) Prior Publication Data

US 2011/0081979 A1 Apr. 7, 2011

(51) Int. Cl.
*A63B 69/36* (2006.01)

(52) U.S. Cl. ..... 473/220; 473/221

(58) Field of Classification Search ..... 473/151, 473/219, 220, 221, 222, 223, 224, 225
See application file for complete search history.

(56) References Cited

U.S. PATENT DOCUMENTS

| | | | | |
|---|---|---|---|---|
| 1,817,896 | A | 8/1931 | Henderson | |
| 3,194,563 | A | 7/1965 | Mackniesh | |
| 3,802,709 | A | 4/1974 | Elkins, Jr. | |
| 4,251,077 | A | 2/1981 | Pelz et al. | |
| 4,306,722 | A | 12/1981 | Rusnak | |
| 4,341,384 | A | 7/1982 | Thackrey | |
| 4,858,934 | A * | 8/1989 | Ladick et al. | 473/220 |
| 4,997,189 | A | 3/1991 | Perkins | |
| 5,692,966 | A | 12/1997 | Wash | |
| 6,383,087 | B1 | 5/2002 | Moser | |
| 6,458,038 | B1 * | 10/2002 | Lin | 473/220 |
| 6,837,799 | B2 * | 1/2005 | Cameron et al. | 473/221 |
| 6,923,728 | B1 * | 8/2005 | Lin | 473/220 |
| 7,228,649 | B2 | 6/2007 | Elliott | |
| 7,286,230 | B1 * | 10/2007 | Salmon | 356/399 |
| 7,744,480 | B2 * | 6/2010 | Gobush | 473/219 |
| 2005/0202888 | A1 * | 9/2005 | Otten et al. | 473/151 |
| 2005/0272516 | A1 * | 12/2005 | Gobush | 473/200 |
| 2007/0197305 | A1 | 8/2007 | Kawai | |
| 2007/0243942 | A1 | 10/2007 | Elliott | |

* cited by examiner

*Primary Examiner* — Nini Legesse

(57) ABSTRACT

Embodiments of methods, apparatus, and systems to identify address position of golf club heads are generally described herein. Other embodiments may be described and claimed.

12 Claims, 7 Drawing Sheets

METHODS, APPARATUS, AND SYSTEMS TO IDENTIFY ADDRESS POSITION OF GOLF CLUB HEADS

TECHNICAL FIELD

The present disclosure relates generally to golf equipment, and more particularly, to methods, apparatus, and systems to identify address position of golf club heads.

BACKGROUND

A golf club head in a squared position at address may produce a more consistent shot relative to an intended target. For example, a golf club head in the squared position at address may cause the golf ball to travel toward the intended target when the golf club head strikes the golf ball. However, if the golf club head is not in the squared position at address, but instead in either an opened position or a closed position, the golf ball may "hook" or "slice" away, respectively, from the intended target when the golf club head strikes the golf ball. Additionally, a golf club head that is not a squared position at address may cause the golf ball to travel at a trajectory higher or lower than that a desired trajectory to reach the intended target. The ability to identify and adjust the address position of a golf club head relative to an intended target may be desirable and beneficial.

DESCRIPTION

In general, methods, apparatus, and systems to identify address position of golf club heads are described herein. The methods, apparatus, and systems described herein are not limited in this regard.

Figure 1:
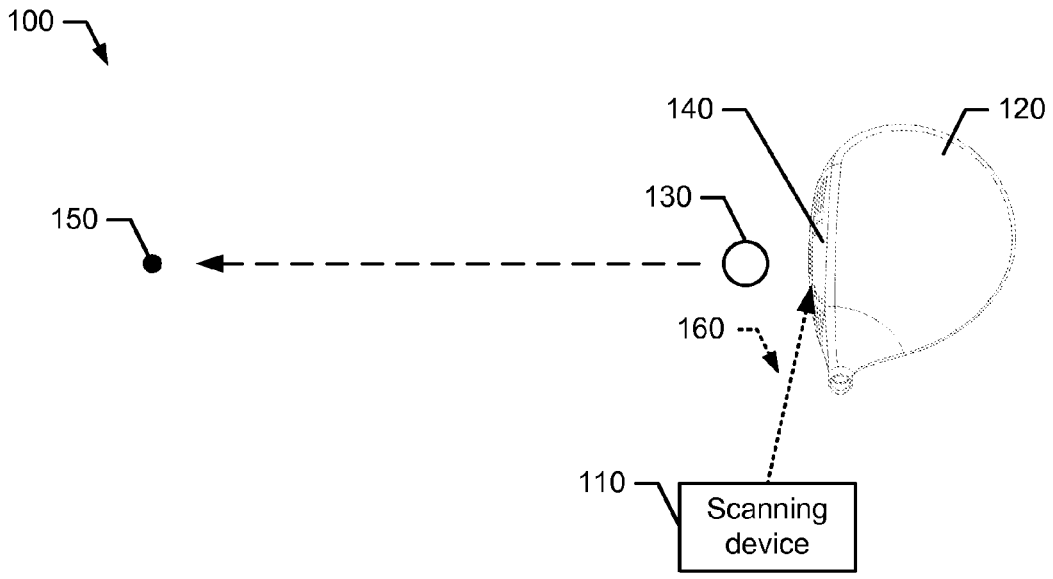
FIG. 1 is a perspective diagram representation of an example address position identification system according to an embodiment of the methods, apparatus, and systems described herein.

Referring to FIG. 1, an address position identification system 100 may include a scanning device 110 and a golf club head 120 of a golf club. In general, the scanning device 110 may be configured to identify an address position of the golf club head 120 to strike a golf ball 130 relative to a target 150 (e.g., a flag associated with a hole, a portion of a fairway, a tree, etc.). For example, the scanning device 110 may include a laser configured to emit optical pulse(s) 160 such as a laser configured to emit a visible light, a laser configured to emit an infrared light, a laser configured to emit an ultraviolet light, or a laser configured to emit X-rays to a club face 140 of the golf club head 120. While the above example may describe particular lasers, the scanning device 110 may include other suitable type of lasers.

Although FIG. 1 may illustrate a particular location of the scanning device 110 relative to the golf club head 120, the scanning device 110 may be located at other suitable positions relative to the golf club head 120 to scan the club face 140 (e.g., the scanning device 110 may be located within a line-of-sight of the club face 140). In one example, the scanning device 110 may be located adjacent to the golf club head 120. Alternatively, the scanning device 110 may be located a distance directly in front of the club face 140. For example, the scanning device 110 may be partially or entirely placed within into the ground (e.g., the scanning device 110 may be incorporated into a device to hold a golf tee or the golf tee itself). The methods, apparatus, and systems described herein are not limited in this regard.

Figure 2:
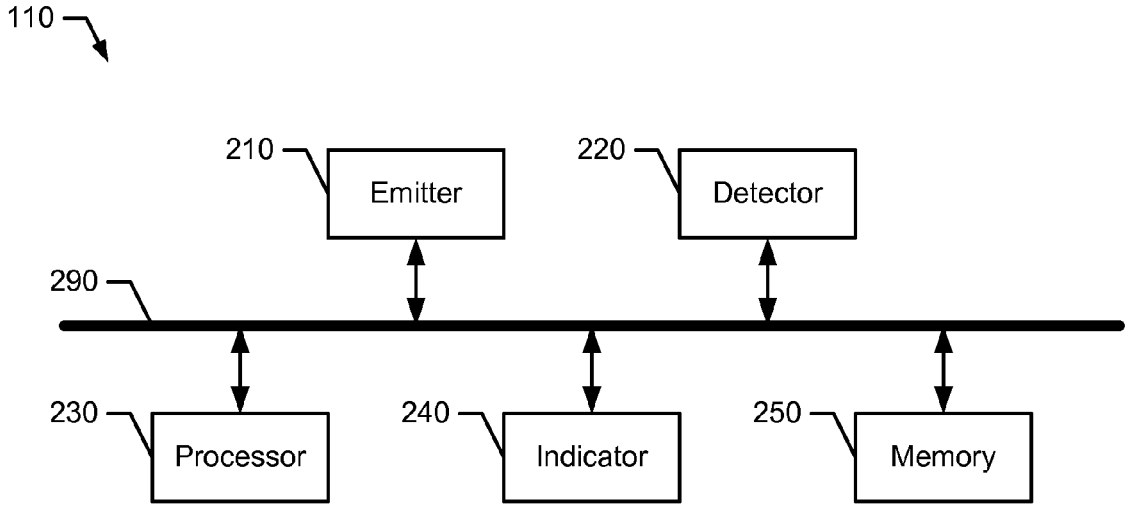
FIG. 2 is a block diagram representation of an example scanning device of FIG. 1.

Turning to FIG. 2, for example, the scanning device 110 may include an emitter 210, a detector 220, a processor 230, an indicator 240, and a memory 250. The emitter 210, the detector 220, the processor 230, the indicator 240, and the memory 250 may be coupled to each other via a bus 290. Alternatively, two or more components of the scanning device 110 may be coupled to each other directly or indirectly.

The scanning device 110 may be configured to determine an address position of the golf club head 120. In general, the emitter 210 may emit optical pulse(s) 160 to scan a contour associated with the club face 140. The detector 220 may detect one or more optical pulse(s) reflected from the club face 140. The processor 230 may process the reflected optical pulse(s) received by the detector 220 to identify the address position of the golf club head 120. The indicator 240 may provide an audio output, a video output, or a combination thereof to indicate the address position of the golf club head 120. The memory 250 may store information associated with the address position of the golf club head 120 (e.g., reference distances of the club face 140 in the squared position).

While FIG. 2 may depict the components of the scanning device 110 being located in a single unit, two or more components of the scanning device 110 may be physically located in separate units (e.g., two or more units). For example, the scanning device 110 may include an emitter unit and a detector unit, which is separate from the emitter unit. In particular, the emitter unit may include the emitter 210 whereas the detector unit may include the detector 220. The processor 230, the indicator 240, and/or the memory 250 may be located in the detector unit. The emitter unit and the detector unit may communicate with each other via one or more communication link(s) (e.g., a wired communication link and/or a wireless communication link). In another example, the emitter 220 and the detector 230 may be located within a single unit, which may communicate with a processing unit via one or more communication link(s) (e.g., a wired communication link and/or a wireless communication link). The processing unit may include the processor 230, the indicator 240, and the memory 250 (e.g., a handheld computer, a laptop computer, etc.). The methods, apparatus, and systems described herein are not limited in this regard.

In the examples of FIGS. 3-12, the golf club head 120 may include a toe end 330, a heel end 332, a front end 334, a back end 336, a face portion 340, a top wall portion 342 (e.g., a crown), and a bottom wall portion 344 (e.g., a sole). The golf club head 120 may be made of a metal material such as titanium, titanium alloy, and/or any other suitable metal or non-metal materials.

The toe end 330 may be opposite of the heel end 332. In a similar manner, the front end 334 may be opposite of the back end 336. The face portion 340 may be located on the front end 334 and configured to impact a golf ball (not shown). In particular, the face portion 340 may include a plurality of grooves 350. The plurality of grooves 350 may be elongated in a direction between the toe end 330 and the heel end 332 on the face portion 340. The top wall portion 342 may be opposite of the bottom wall portion 344. At or proximate to the heel end 332, the golf club head 120 may include a hosel 360. To form a golf club, one end of a shaft (not shown) may be inserted into the hosel 360. On the opposite end of the shaft, a grip (not shown) may be coupled to the shaft.

Although FIGS. 3-12 may depict a utility club head or a metal wood-type club head (e.g., drivers, fairway woods, etc.), the methods, apparatus, and systems described herein may be readily applicable to other suitable types of golf club heads. For example, the methods, apparatus, and systems described herein may be applicable to hybrid-type club heads, iron-type club heads, wedge-type club heads, or other suitable types of golf club heads. The methods, apparatus, and systems described herein are not limited this regard.

Figure 3:
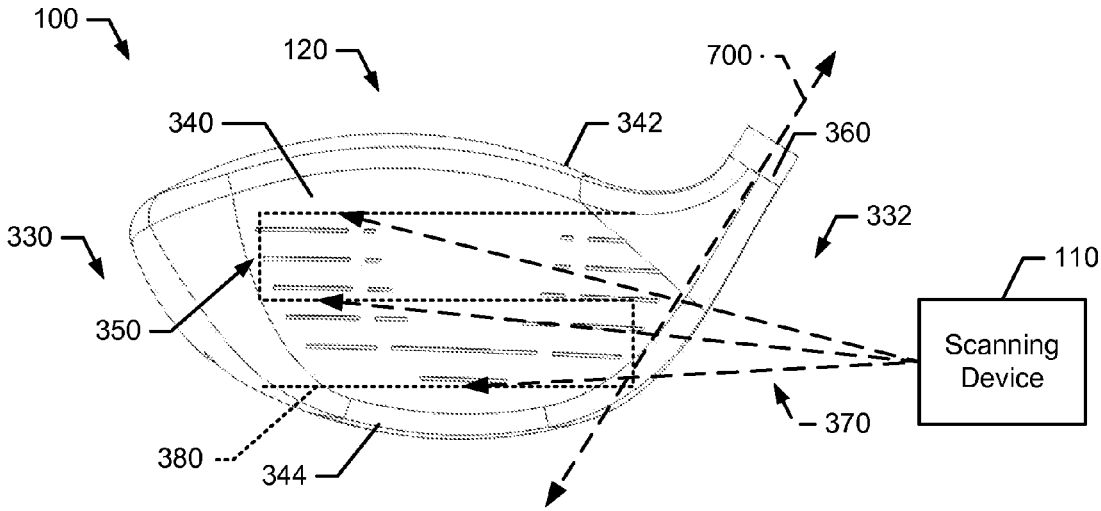
FIG. 3 depicts a first example scanning pattern of a golf club head by the example scanning device of FIG. 1.
Figure 4:
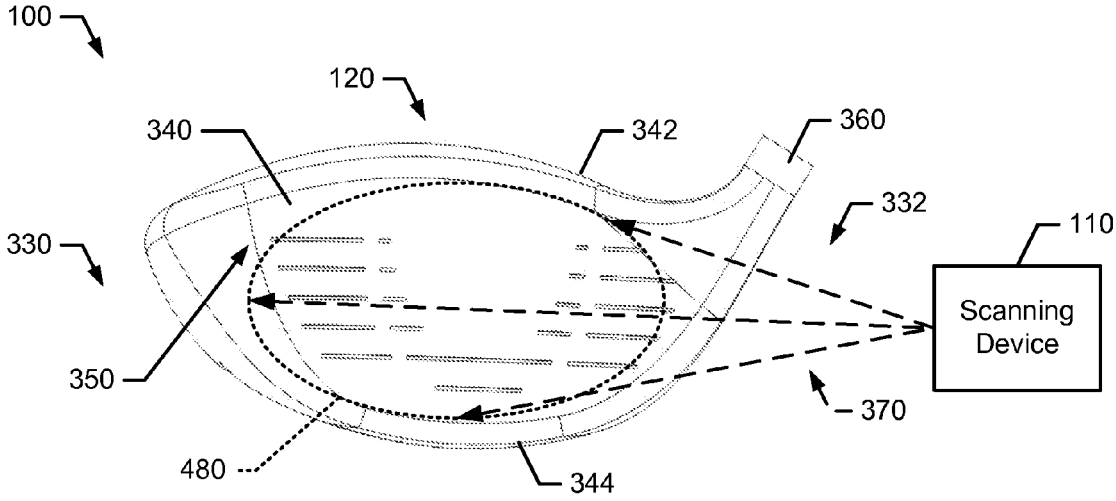
FIG. 4 depicts a second example scanning pattern of a golf club head by the example scanning device of FIG. 1.
Figure 5:
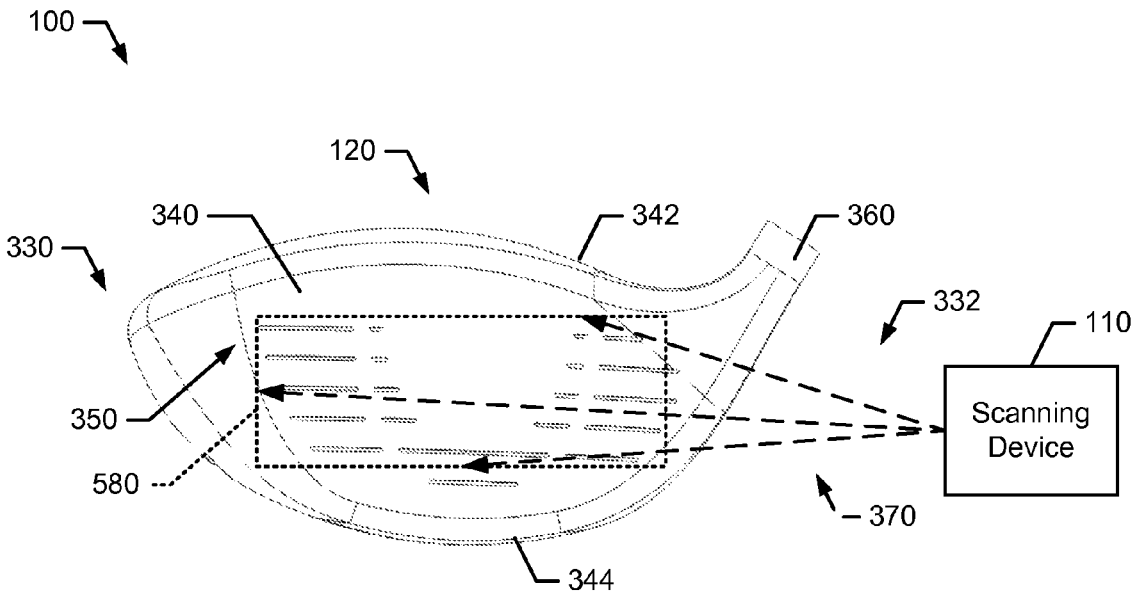
FIG. 5 depicts a third example scanning pattern of a golf club head by the example scanning device of FIG. 1.
Figure 6:
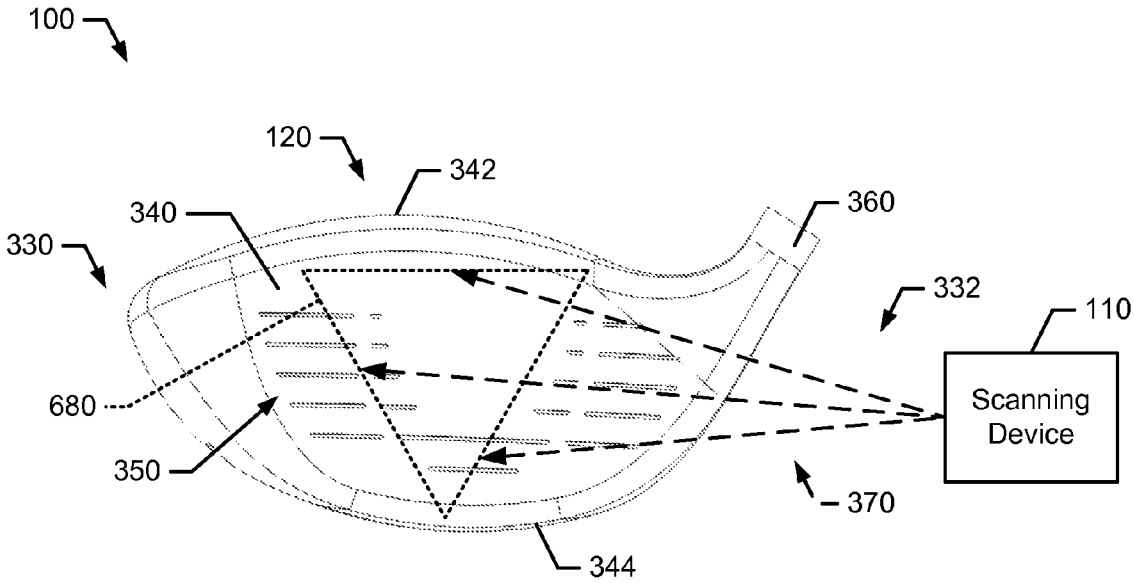
FIG. 6 depicts a fourth example scanning pattern of a golf club head by the example scanning device of FIG. 1.

As illustrated in FIGS. 3-6, for example, the scanning device 110 may scan the club face 350 in various patterns (e.g., lines, polygons, etc.). In the example of FIG. 3, the scanning device 110 (e.g., via the emitter 210 of FIG. 2) may generate one or more optical pulses 370 in a linear manner such as an S-shaped pattern 380. In another example, as illustrated in FIG. 4, the scanning device 110 may generate one or more optical pulses 370 in a circular pattern or an elliptical pattern 480. Referring to FIG. 5, for example, the scanning device 110 may generate one or more optical pulses 370 in a rectangular pattern 580. Alternatively, the scanning device 110 may generate one or more optical pulses 370 in a triangular pattern 680. Although the above figures may depict particular patterns, the scanning device 110 may generate one or more optical pulses in various manners such as freestyle and/or random manners (e.g., no particular pattern).

In general, the address position of the golf club head 120 may be determined by the position of the club face 340 relative to a vertical plane (710 of FIG. 7), a ground plane (1010 of FIG. 10), and/or a loft plane (1020 of FIG. 10) at address. As described in detail below, for example, the golf club head 120 may be in an opened position, closed position, or squared position relative to a vertical plane. The golf club head 120 may also be in an upward position, a downward position, or a squared position relative to a loft plane and/or a ground plane.

Figure 8:
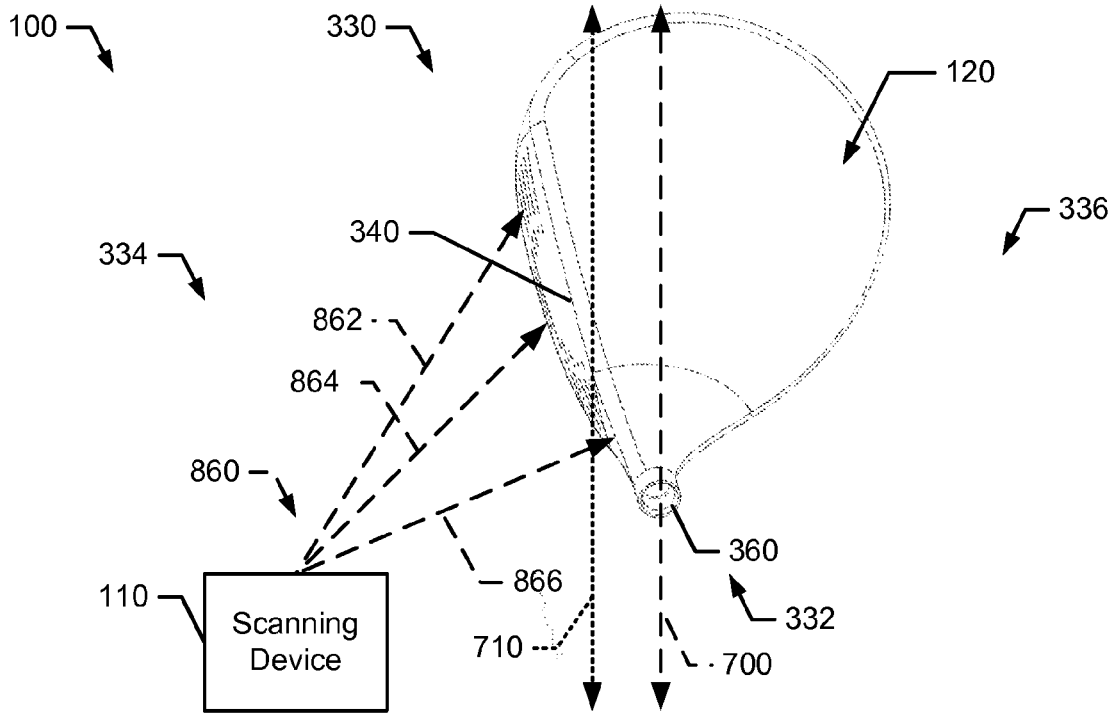
FIG. 8 depicts a second example top view of the address position identification system of FIG. 1.
Figure 9:
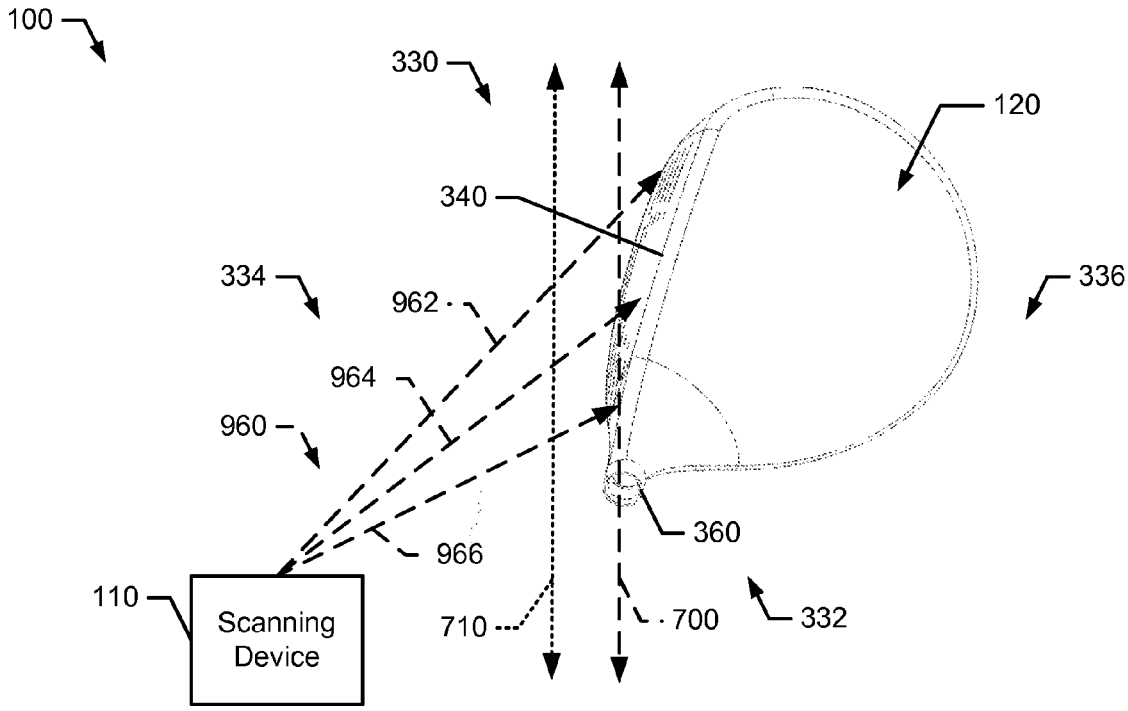
FIG. 9 depicts a third example top view of the address position identification system of FIG. 1.
Figure 10:
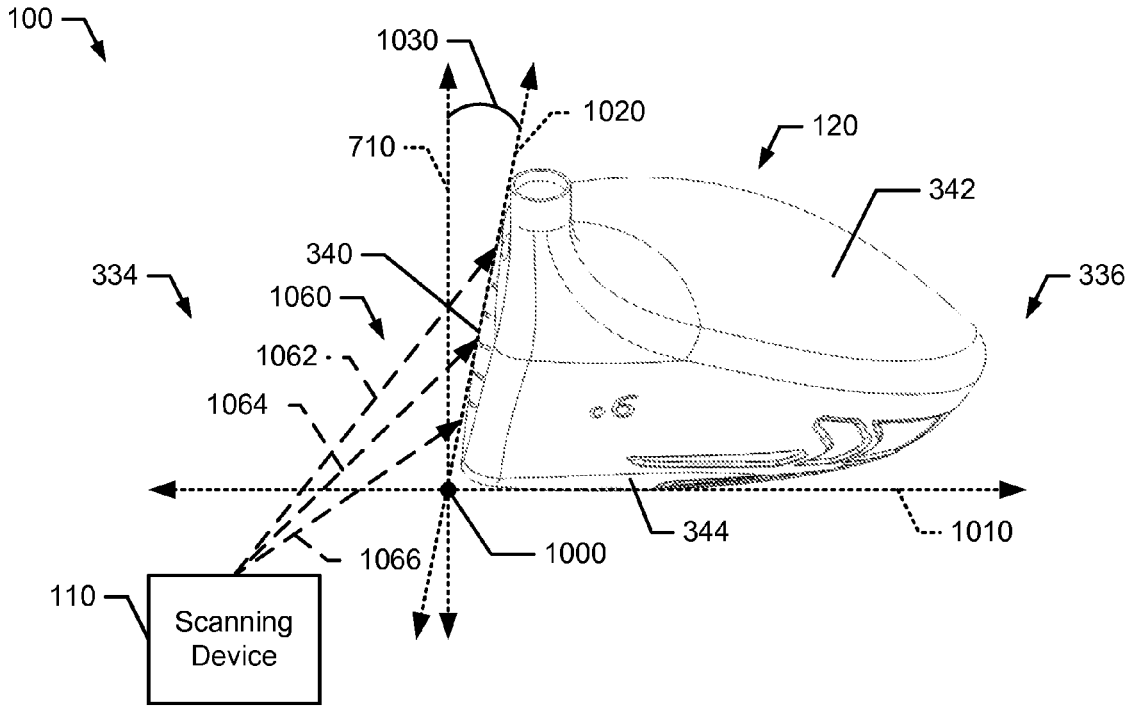
FIG. 10 depicts a first example heel end view of the address position identification system of FIG. 1.

As illustrated in FIGS. 7-12, for example, the golf club head 120 may be associated with a hosel axis 700 (FIG. 7) and a plane axis 1000 (FIG. 10). Further, the golf club head 120 may be associated with a vertical plane 710 (FIG. 7), a ground plane 1010 (FIG. 10), and a loft plane 1020 (FIG. 10). The hosel axis 700 may extend through the hosel 346 (e.g., FIG. 3). The hosel axis 700 may be parallel to the vertical plane 710. Turning to FIG. 10, for example, the vertical plane 710 and the ground plane 1010 may be normal or perpendicular to each other. The vertical plane 710 and the loft plane 1020 may define a loft angle 1030 of the golf club head 120. The vertical plane 710, the ground plane 1010, and the loft plane 1020 may intersect at the plane axis 1000.

Referring back to FIG. 7, for example, the golf club head 120 may be in a squared position relative to the vertical plane 710 such that the club face 340 may be substantially perpendicular to a target (e.g., the target 150 of FIG. 1). In the squared position associated with the hosel axis 700, the golf club head 120 may not extend across the vertical plane 710. The distance of one or more optical pulses 760, generally shown as 762, 764, and 766, between the scanning device 110 and the club face 340 may be used as references by the scanning device 110 to identify the address position of the golf club head 120. In particular, the optical pulse 762 may be associated with a distance between the scanning device 110 and a portion of the club face 340 at or proximate to the toe end 330 of the golf club head 120. The optical pulse 764 may be associated with a distance between the scanning device 110 and a portion at or proximate to a center of the club face 340. The optical pulse 766 may be associated with a distance between the scanning device 110 and a portion of the club face 340 at or proximate to the heel end 332 of the golf club head 120. The methods, apparatus, and articles of manufacture described herein are not limited in this regard.

Figure 7:
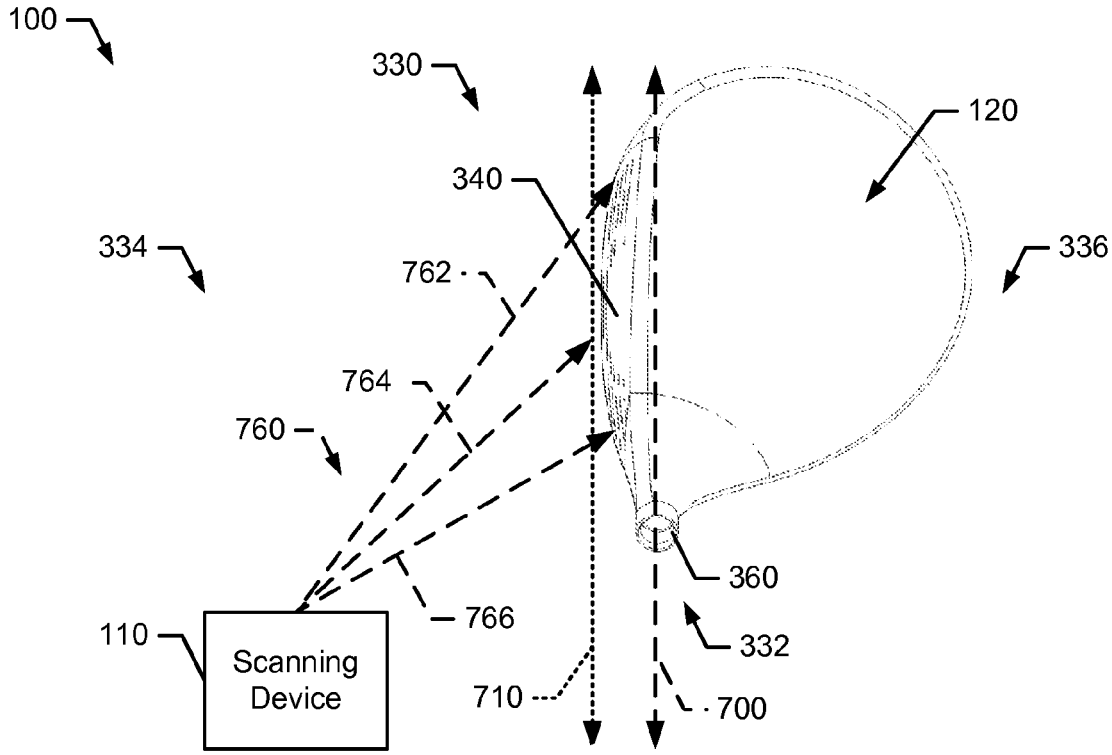
FIG. 7 depicts a first example top view of the address position identification system of FIG. 1.

As illustrated in FIG. 8, for example, the golf club head 120 may be in a closed position relative to the vertical plane 710. In contrast to the squared position as depicted in FIG. 7, a portion of the golf club head 120 may extend across the vertical plane 710 (e.g., a portion at or proximate to the toe end 330 of the golf club head 120). In the closed position, the club face 340 of the golf club head 120 may be rotated along the hosel axis 700 in a counter-clockwise manner towards the vertical plane 710 relative to the squared position (FIG. 7). For example, the toe end 330 of the club face 340 may extend across the vertical plane 710 in the closed position whereas the toe end 330 of the club face 340 may not extend across the vertical plane 710 in the squared position (FIG. 7). In the closed position, the heel end 332 of the club face 340 may be farther away from the vertical plane 710 than when the heel end 332 of the club face 340 may be in the squared position (FIG. 7).

The scanning device 110 (e.g., via the processor 230) may determine and identify an address position of the golf club head 120 by calculating the distance of one or more optical pulses 860, generally shown as 862, 864, and 866, between the scanning device 110 and the club face 340 of the golf club head 120. In particular, the optical pulse 862 may be associated with a distance between the scanning device 110 and a portion of the club face 340 at or proximate to the toe end 330 of the golf club head 120. The optical pulse 864 may be associated with a distance between the scanning device 110 and a portion at or proximate to a center of the club face 340. The optical pulse 866 may be associated with a distance between the scanning device 110 and a portion of the club face 340 at or proximate to the heel end 332 of the golf club head 120.

As noted above, the optical pulses 760 may be associated with the golf club head 120 being in a squared position. Accordingly, the scanning device 110 may be calibrated to use the distances associated with the optical pulses 760 as reference. The scanning device 110 may compare the distances associated with the optical pulses 860 with the distances associated with the optical pulses 760 (e.g., the distances between the scanning device 110 and the club face 340 when the club face 340 is in the squared position relative to a vertical plane 710). For example, the club face 340 may be in the closed position if: (1) the distance of the optical pulse 862 is less than the distance of the optical pulse 762, (2) the distance of the optical pulse 864 is less than the distance of the optical pulse 764, and/or (3) the distance of the optical pulse 866 is greater than the distance of the optical pulse 766. The methods, apparatus, and articles of manufacture described herein are not limited in this regard.

Turning to FIG. 9, for example, the golf club head 120 may be in an opened position relative to the vertical plane 710. Similar to the closed position as depicted in FIG. 8, a portion of the golf club head 120 may extend across the vertical plane 710 in the opened position. In contrast to the closed position, however, a portion at or proximate to the heel end 332 of the golf club head 120 may extend across the vertical plane 710 in the opened position instead of a portion at or proximate to the toe end 330 of the golf club head 120 (FIG. 8). In the opened position, the club face 340 of the golf club head 120 may be rotated along the hosel axis 700 in a clockwise manner away from the vertical plane 710 relative to the squared position (FIG. 7). For example, the heel end 332 of the club face 340 may extend across the vertical plane 710 in the opened position whereas the heel end 332 of the club face 340 may not extend across the vertical plane 710 in the squared position (FIG. 7). In the opened position, the toe end 330 of the club face 340 may be farther away from the vertical plane 710 than when the toe end 330 of the club face 340 may be in a squared position (FIG. 7).

The scanning device 110 (e.g., via the processor 230) may determine and identify an address position of the golf club head 120 by calculating the distance of one or more optical pulses 960, generally shown as 962, 964, and 966, between the scanning device 110 and the club face 340 of the golf club head 120. In particular, the optical pulse 962 may be associated with a distance between the scanning device 110 and a portion of the club face 340 at or proximate to the toe end 330 of the golf club head 120. The optical pulse 964 may be associated with a distance between the scanning device 110 and a portion at or proximate to a center of the club face 340. The optical pulse 966 may be associated with a distance between the scanning device 110 and a portion of the club face 340 at or proximate to the heel end 332 of the golf club head 120.

The scanning device 110 may compare the distances associated with the optical pulses 960 with the distances associated with the optical pulses 760 (e.g., the distances between the scanning device 110 and the club face 340 when the club face 340 is in the squared position relative to a vertical plane 710). For example, the club face 340 may be in the opened position if: (1) the distance of the optical pulse 962 is greater than the distance of the optical pulse 762, (2) the distance of the optical pulse 964 is greater than the distance of the optical pulse 764, and/or (3) the distance of the optical pulse 966 is less than the distance of the optical pulse 766. The methods, apparatus, and articles of manufacture described herein are not limited in this regard.

Figure 11:
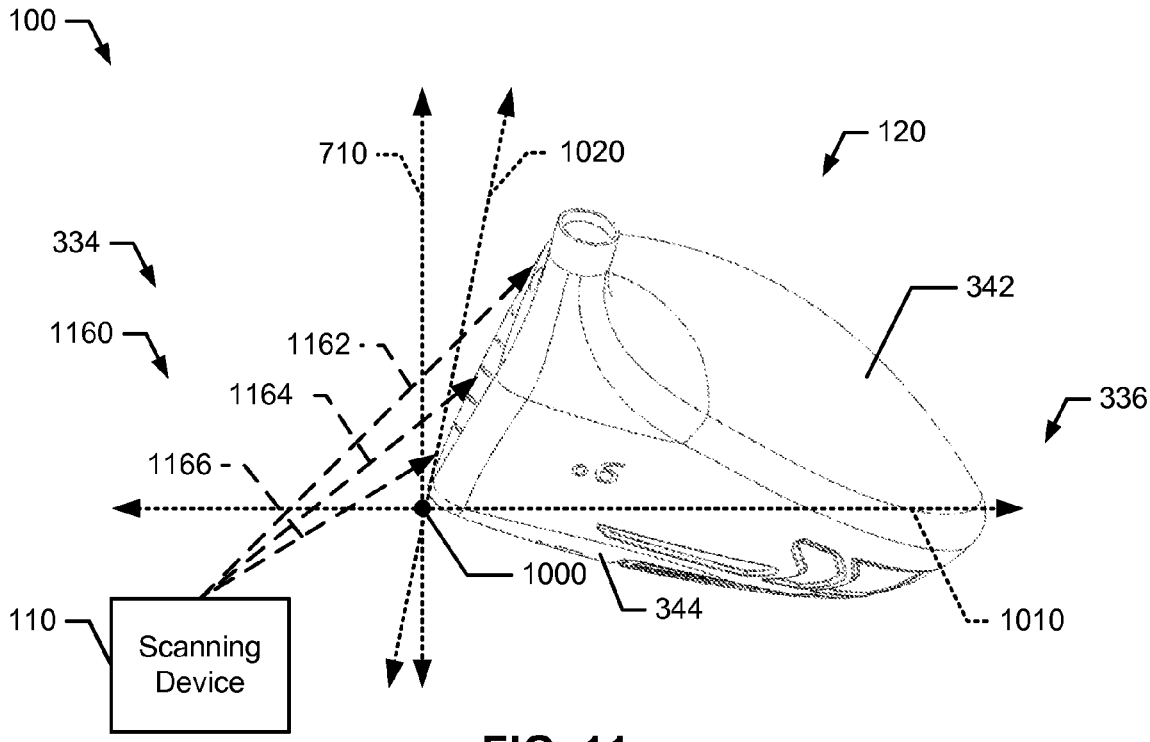
FIG. 11 depicts a second example heel end view of the address position identification system of FIG. 1.

In addition to the various orientations of the golf club head 120 relative to the hosel axis 710 as described above, the golf club head 120 may be positioned in various orientations relative to the plane axis 1010. Referring to FIG. 10, for example, the golf club head 120 may be in a squared position relative to the ground plane 1010 and/or the loft plane 1020. In the square position associated with the plane axis 1000, the golf club head 120 may not extend across the loft plane 1020. The distance of one or more optical pulses 1060, generally shown as 1062, 1064, and 1066, between the scanning device 110 and the club face 340 may be used as references by the scanning device 110 to identify the address position of the golf club head 120. In particular, the optical pulse 1062 may be associated with a distance between the scanning device 110 and a portion of the club face 340 at or proximate to the top wall portion 342 of the golf club head 120. The optical pulse 764 may be associated with a distance between the scanning device 110 and a portion at or proximate to a center of the club face 340. The optical pulse 1066 may be associated with a distance between the scanning device 110 and a portion of the club face 340 at or proximate to the bottom wall portion 344 of the golf club head 120. The methods, apparatus, and articles of manufacture described herein are not limited in this regard. As illustrated in FIG. 11, for example, the golf club head 120 may be in an upward position relative to the ground plane 1010 and/or the loft plane 1020. In contrast to the squared position as depicted in FIG. 10, a portion of the golf club head 120 may extend across the ground plane 1010 (e.g., a portion at or proximate to the toe end 330 of the golf club head 120). In the upward position as illustrated in FIG. 11, the club face 340 of the golf club head 120 may be rotated along the plane axis 1000 in a clockwise manner away from the loft plane 1020 and towards the ground plane 1010 relative to the squared position (FIG. 10). For example, the back end 336 of the golf club head 120 may extend across the ground plane 1010 in the upward position whereas the back end 336 of the golf club head 120 may not extend across the ground plane 1010 in the squared position (FIG. 10). In the upward position, the top wall portion 342 of the golf club head 120 may be farther away from the loft plane 1020 than when the top wall portion 342 of the golf club head 120 may be in the squared position (FIG. 10).

The scanning device 110 (e.g., via the processor 230) may determine and identify an address position of the golf club head 120 by calculating the distance of one or more optical pulses 1160, generally shown as 1162, 1164, and 1166, between the scanning device 110 and the club face 340 of the golf club head 120. In particular, the optical pulse 1162 may be associated with a distance between the scanning device 110 and a portion of the club face 340 at or proximate to the top wall portion 342 of the golf club head 120. The optical pulse 1164 may be associated with a distance between the scanning device 110 and a portion at or proximate to a center of the club face 340. The optical pulse 1166 may be associated with a distance between the scanning device 110 and a portion of the club face 340 at or proximate to the bottom wall portion 344 of the golf club head 120.

The scanning device 110 may compare the distances associated with the optical pulses 1160 with the distances associated with the optical pulses 1060 (e.g., the distances between the scanning device 110 and the club face 340 when the club face 340 is in the squared position relative to the ground plane 1010 and the loft plane 1020). For example, the club face 340 may be in the upward position if: (1) the distance of the optical pulse 1162 is greater than the distance of the optical pulse 1062, (2) the distance of the optical pulse 1164 is greater than the distance of the optical pulse 1064, and/or (3) the distance of the optical pulse 1166 is greater than the distance of the optical pulse 1066. The methods, apparatus, and articles of manufacture described herein are not limited in this regard.

Figure 12:
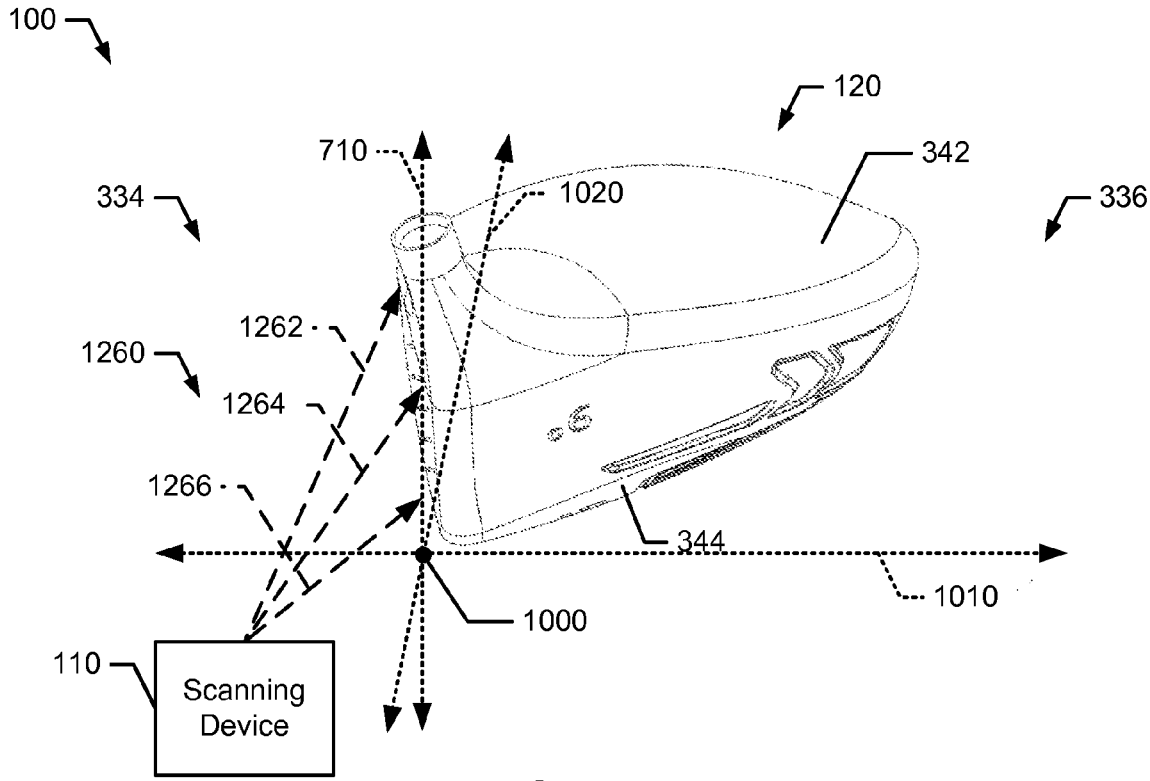
FIG. 12 depicts a third example heel end view of the address position identification system of FIG. 1.

Turning to FIG. 12, for example, the golf club head 120 may be in a downward position relative to the ground plane 1010 and/or the loft plane 1020. In contrast to the upward position as depicted in FIG. 11, a portion at or proximate to the front end 334 of the golf club head 120 may extend across the loft plane 1020 in the downward position instead of the back end 336 extending across the ground plane 1010 (FIG. 11). In the downward position as illustrated in FIG. 12, the club face 340 of the golf club head 120 may be rotated along the plane axis 1000 in a counter-clockwise manner away from the ground plane 1010 and towards the loft plane 1020 relative to the squared position (FIG. 10). For example, the front end 334 of the golf club head 120 may extend across the loft plane 1020 in the downward position whereas the front end 334 of the golf club head 120 may not extend across the loft plane 1020 in the squared position (FIG. 10). In the downward position, the top wall portion 342 of the golf club head 120 may be closer the ground plane 1010 than when the top wall portion 342 of the golf club head 120 may be in the squared position (FIG. 10).

The scanning device 110 (e.g., via the processor 230) may determine and identify an address position of the golf club head 120 by calculating the distance of one or more optical pulses 1260, generally shown as 1262, 1264, and 1266, between the scanning device 110 and the club face 340 of the golf club head 120. In particular, the optical pulse 1262 may be associated with a distance between the scanning device 110 and a portion of the club face 340 at or proximate to the top wall portion 342 of the golf club head 120. The optical pulse 1264 may be associated with a distance between the scanning device 110 and a portion at or proximate to a center of the club face 340. The optical pulse 1266 may be associated with a distance between the scanning device 110 and a portion of the club face 340 at or proximate to the bottom wall portion 344 of the golf club head 120.

The scanning device 110 may compare the distances associated with the optical pulses 1260 with the distances associated with the optical pulses 1060 (e.g., the distances between the scanning device 110 and the club face 340 when the club face 340 is in the squared position relative to the ground plane 1010 and the loft plane 1020). For example, the club face 340 may be in the downward position if: (1) the distance of the optical pulse 1262 is less than the distance of the optical pulse 1062, (2) the distance of the optical pulse 1264 is less than the distance of the optical pulse 1064, and/or (3) the distance of the optical pulse 1266 is less than the distance of the optical pulse 1066. The methods, apparatus, and articles of manufacture described herein are not limited in this regard.

After the scanning device 110 (via the processor 230) determines the address position of the golf club head 120 relative to the vertical plane 710, the ground plane 1010, and/or the loft plane 1020, the address position of the golf club head 120 may be relayed to an individual. The scanning device 110 (e.g., via an indicator 240) may relay the address position of the golf club head 120 as a closed position, an opened position, or a squared position relative to the vertical plane 710 as illustrated in FIGS. 7, 8, and 9, respectively. In addition or alternatively, the scanning device 110 (e.g., via an indicator 240) may relay the address position of the golf club head 120 as an upward position, a downward position, or a squared position relative to the ground plane 1010 and/or the loft plane 1020 as illustrated in FIGS. 10, 11, and 12, respectively. The indicator 240 may provide the address position of the golf club head 120 via an audio output (e.g., sound), a visual output (e.g., display), a combination thereof, and/or other suitable types of output.

Although the above examples may depict a particular number of optical pulses, the methods, apparatus, and systems described herein may use more or less optical pulses to identify address position of golf club heads. For example, the address position identification system 100 may use more optical pulses to produce relatively more accurate results. While the above examples may describe the golf club head 120 in particular orientations relative to right-handed individuals, the methods, apparatus, and systems may be applicable to golf club heads of golf clubs for left-handed individuals. The methods, apparatus, and articles of manufacture described herein are not limited in this regard.

Figure 13:
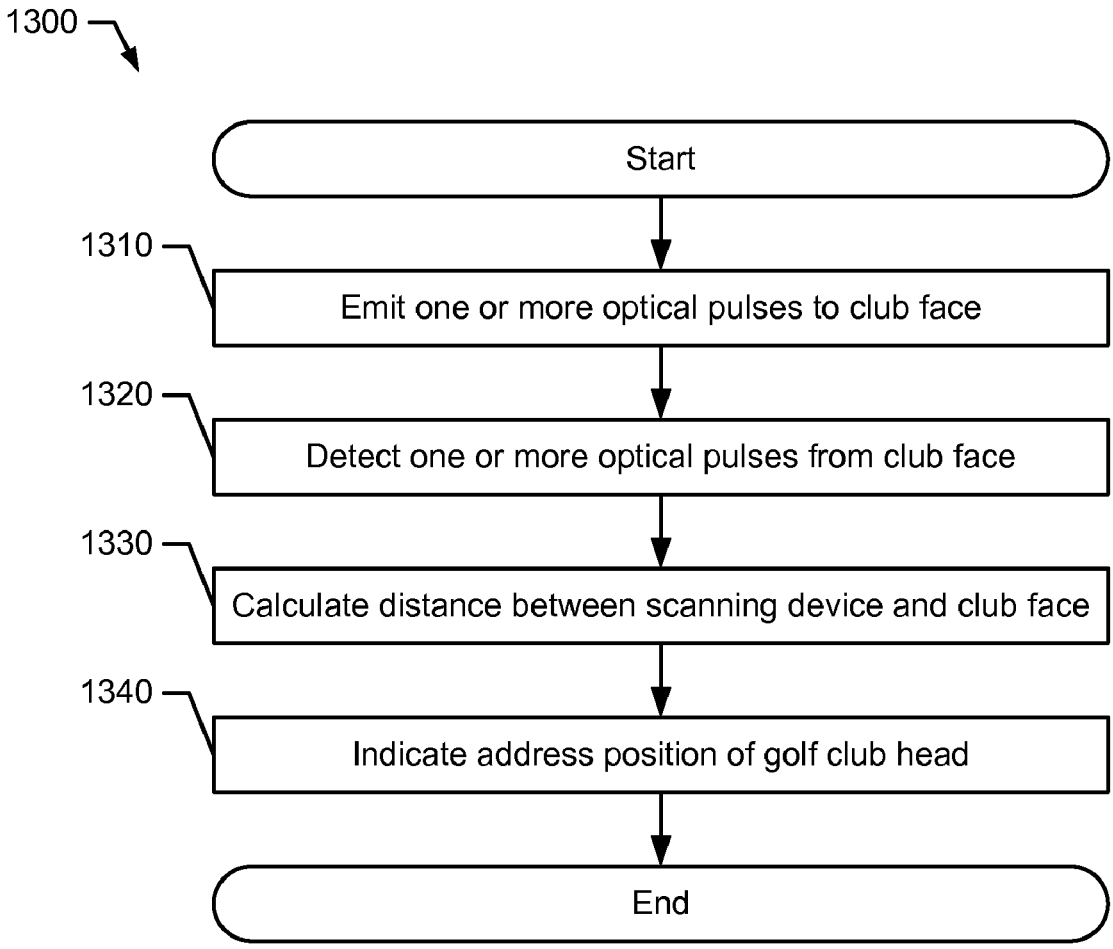
FIG. 13 is a flow diagram representation of one manner in which the address position identification system may operate.

In the example of FIG. 13, a process 1300 may begin with the scanning device 110 (e.g., via the emitter 210) emitting one or more optical pulse(s) 160 to the club face 140 of the golf club head 110 (block 1310). As noted above, the optical pulse(s) 160 may consist of a visible light, an infrared light, an ultraviolet light, an X-ray, a combination thereof, or any other suitable types of electromagnetic wave. The scanning device 110 may emit the optical pulses 160 in a linear pattern, a non-linear pattern, a circular pattern, an elliptical pattern, a triangular pattern, a rectangular pattern, a polygonal pattern, a combination thereof, or any other suitable manner (e.g., freestyle or random manner).

The process 1300 may detect (e.g., via the detector 220) one or more optical pulses 160 reflected from the club face 140 (block 1320). Accordingly, the process 1300 may calculate (e.g., via the processor 230) distance between the scanning device 110 and the club face 140 (block 1330). By calculating the distance between the scanning device 120 and the club face 140, the processor 230 to determine the address position of the golf club head 120 relative to the vertical plane 710, the ground plane 1010, and/or the loft plane 1020.

The process 1300 may indicate (e.g., via the indicator 240) the address position of the golf club head 120 (block 1340). For example, the indicator 240 may indicate that the golf club head 120 may be in an opened position, a closed position, or a squared position relative to the vertical plane 710. In addition or alternatively, the indicator 240 may indicate that the golf club head 120 may be in an upward position, a downward position, or a squared position relative to the ground plane 1010 and/or the loft plane 1020. As noted above, the indicator 240 may provide the address position of the golf club head 120 via an audio output (e.g., sound), a visual output (e.g., display), a combination thereof, and/or other suitable types of output. Based on the output from the indicator 240, an individual may adjust the address position of the golf club head 120 accordingly. The methods, apparatus, and articles of manufacture described herein are not limited in this regard.

While a particular order of actions is illustrated in FIG. 13, these actions may be performed in other temporal sequences. For example, two or more actions depicted in FIG. 13 may be performed sequentially, concurrently, or simultaneously. Although, the process 1300 may be described above with respect to the golf club head 120, the process 1300 may be applicable to other golf club heads. Further, while the above examples may be described with respect to golf club heads, the methods, apparatus, and systems described herein may be applicable to other sports equipment.

Although certain example methods, apparatus, and/or articles of manufacture have been described herein, the scope of coverage of this disclosure is not limited thereto. On the contrary, this disclosure covers all methods, apparatus, and/or articles of manufacture fairly falling within the scope of the appended claims either literally or under the doctrine of equivalents.

What is claimed is:

1. An apparatus comprising:

a detector configured to detect one or more optical pulses from a club face of a golf club head;

an indicator configured to indicate an address position of the golf club head based on the one or more optical pulses; and an emitter configured to emit the one or more optical pulses in various predetermined patterns.

2. The apparatus as defined in claim 1, wherein the emitter is configured to emit the one or more optical pulses in at least one of a linear pattern, a non-linear pattern, a circular pattern, an elliptical pattern, a triangular pattern, a rectangular pattern, or a polygonal pattern.

3. The apparatus as defined in claim 1 further comprising:

a processor to determine one or more distances between the apparatus and the club face.

4. The apparatus as defined in claim 1 further comprising:

a processor to identify at least one of an opened position, or a squared position based on one or more distances between the apparatus and the club face.

5. The apparatus as defined in claim 1, wherein the indicator is configured to indicate at least one of an opened position, a closed position, an upward position, a downward position, or a squared position.

6. The apparatus as defined in claim 1, wherein the indicator comprises an indicator to provide at least one of a visual output or an audio output associated with the address position.

7. The apparatus as defined in claim 1, wherein the golf club head comprises at least one of a driver-type golf club head, a fairway wood-type golf club head, a hybrid-type golf club head, an iron-type golf club head, a wedge-type golf club head, or a putter-type golf club head.

8. A system comprising:

a laser configured to scan a contour associated with a club face of a golf club head, wherein the laser generates one or more optical pulses in various predetermined patterns to scan the contour associated with the club face; and a processor configured to identify an address position of the golf club head based on the contour.

9. The system as defined in claim 8, wherein the laser is configured to scan the contour in at least one of a linear pattern, a non-linear pattern, a circular pattern, an elliptical pattern, a triangular pattern, a rectangular pattern, or a polygonal pattern.

10. The system as defined in claim 8, wherein the laser comprises at least one of a laser configured to emit a visible light, a laser configured to emit an infrared light, a laser configured to emit an ultraviolet light, or a laser configured to emit X-rays.

11. The system as defined in claim 8, wherein the processor is configured to identify at least one of an opened position, a closed position, an upward position, a downward position, or a squared position based on one or more distances between the apparatus and the club face.

12. The system as defined in claim 8 further comprising an output device to indicate the address position of the golf club head.

* * * * *